US006951470B1

(12) United States Patent
Huang

(10) Patent No.: US 6,951,470 B1
(45) Date of Patent: Oct. 4, 2005

(54) SIM CARD SEAT ASSEMBLY

(76) Inventor: Huang-Chou Huang, No. 59, Sec. 1, Jiow Juang St., Nankang Dist., Taipei (TW)

( * ) Notice: Subject to any disclaimer, the term of this patent is extended or adjusted under 35 U.S.C. 154(b) by 0 days.

(21) Appl. No.: 10/970,918

(22) Filed: Oct. 22, 2004

(51) Int. Cl.[7] ..... H01R 13/62
(52) U.S. Cl. ..... 439/159; 439/630; 439/923; 455/90
(58) Field of Search ..... 439/155–159, 439/326, 629–630, 923; 455/90

(56) References Cited

U.S. PATENT DOCUMENTS 5,257,414 A * 10/1993 Trahan et al. ..... 455/558
5,655,917 A * 8/1997 Kaneshige et al. ..... 439/155
6,053,748 A * 4/2000 Bricaud et al. ..... 439/76.1
6,210,193 B1 * 4/2001 Ito et al. ..... 439/326
6,226,189 B1 * 5/2001 Haffenden et al. ..... 361/814

* cited by examiner

*Primary Examiner*—Truc Nguyen
(74) *Attorney, Agent, or Firm*—Alan D. Kamrath; Nikolai & Mersereau, P.A.

(57) ABSTRACT

A SIM seat assembly has a base, terminals, two ejection arms and two mounting tabs. The terminals are mounted in the base and have inclined resilient contacts. The ejection arms are mounted on the base and have resilient arms. The mounting tabs are connected to the base. When a SIM card is installed in or removed from the SIM card seat assembly, the SIM card presses against the resilient contacts and presses the resilient contacts toward the base. The connect area between the resilient contacts and the chips on the SIM card are small. The chips SIM card are not able to be scratched by the terminals. Furthermore, the resilient arms push the SIM card out of the SIM card seat assembly when the SIM card is removed from the SIM card seat assembly so the SIM card can be removed without any difficulty.

2 Claims, 5 Drawing Sheets

SIM CARD SEAT ASSEMBLY

BACKGROUND OF THE INVENTION

1. Field of the Invention

The present invention relates to a SIM (Subscriber Identity Module) card assembly that selectively ejects the SIM card out of the SIM card seat assembly.

2. Description of Related Art

A SIM card is an essential part of virtually all modern cell phones. The SIM card is mounted in a SIM card seat in the cell phone so the SIM card is able to function.

With reference to FIG. 5, the SIM card seat comprises a base (30) and terminals (34). The base (30) is mounted in the casing of the cell phone, and has a top surface (not numbered), holes (33), a right edge (not numbered), a left edge (not numbered), a curved edge (31) and a lip (32). The holes (33) are formed through the base (30). The curved edge (31) is formed in the right edge of the base (30). The lip (32) is formed on the left edge of the base (30) and extends up from the top surface of the base (30).

The terminals (34) are mounted inside the holes (33) in the base (30), and each terminal (34) has a curved surface (not numbered) mounted in the holes (33) in the base (30) and protrude from the top surface of the base (30).

When a SIM card is mounted inside the casing of the cell phone, chips on the SIM card abut the curved surface of the terminals (34) so the SIM card can function. However, the terminals (34) only can provide a little of the resilient force so the curved surface is closely touched the chips on the terminals (34). When the SIM card is removed from or placed into the conventional SIM card seat, the curved surface scratches the chips on the SIM card.

The scratches on the chips on the SIM card make the chips susceptible to oxidation, and the SIM card cannot work anymore.

Furthermore, the SIM card seat in the cell phone casing is very narrow, and pulling the SIM card out of the SIM card seat is very difficult. Furthermore, the conventional SIM card seat does not provide any force to assist in removal of the SIM card.

To overcome the shortcomings, the present invention provides a SIM card seat to obviate or mitigate the aforementioned problems.

SUMMARY OF THE INVENTION

The primary objective of the present invention is to provide an improved SIM card seat assembly that provides a force to remove the SIM card and protect the chips on the SIM card.

The SIM card seat assembly has a base, terminals, ejection arms and mounting tabs. The terminals are mounted in the base and have inclined resilient contacts. The ejection arms are mounted on the base and have resilient arms. The mounting tabs are connected to the base. When a SIM card is installed in or removed from the SIM card seat assembly, the SIM card presses against the resilient contacts and presses the resilient contacts toward the base. The resilient contacts press against the chips on the SIM card with a small area, and the resilient contacts are easily deformed temporarily when the SIM card is inserted or removed. The chips on the SIM card are not able to be scratched by the terminals. Furthermore, the resilient arms push the SIM card out of the SIM card seat assembly when the SIM card is removed from the SIM card seat assembly so the SIM card can be removed without any difficulty.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
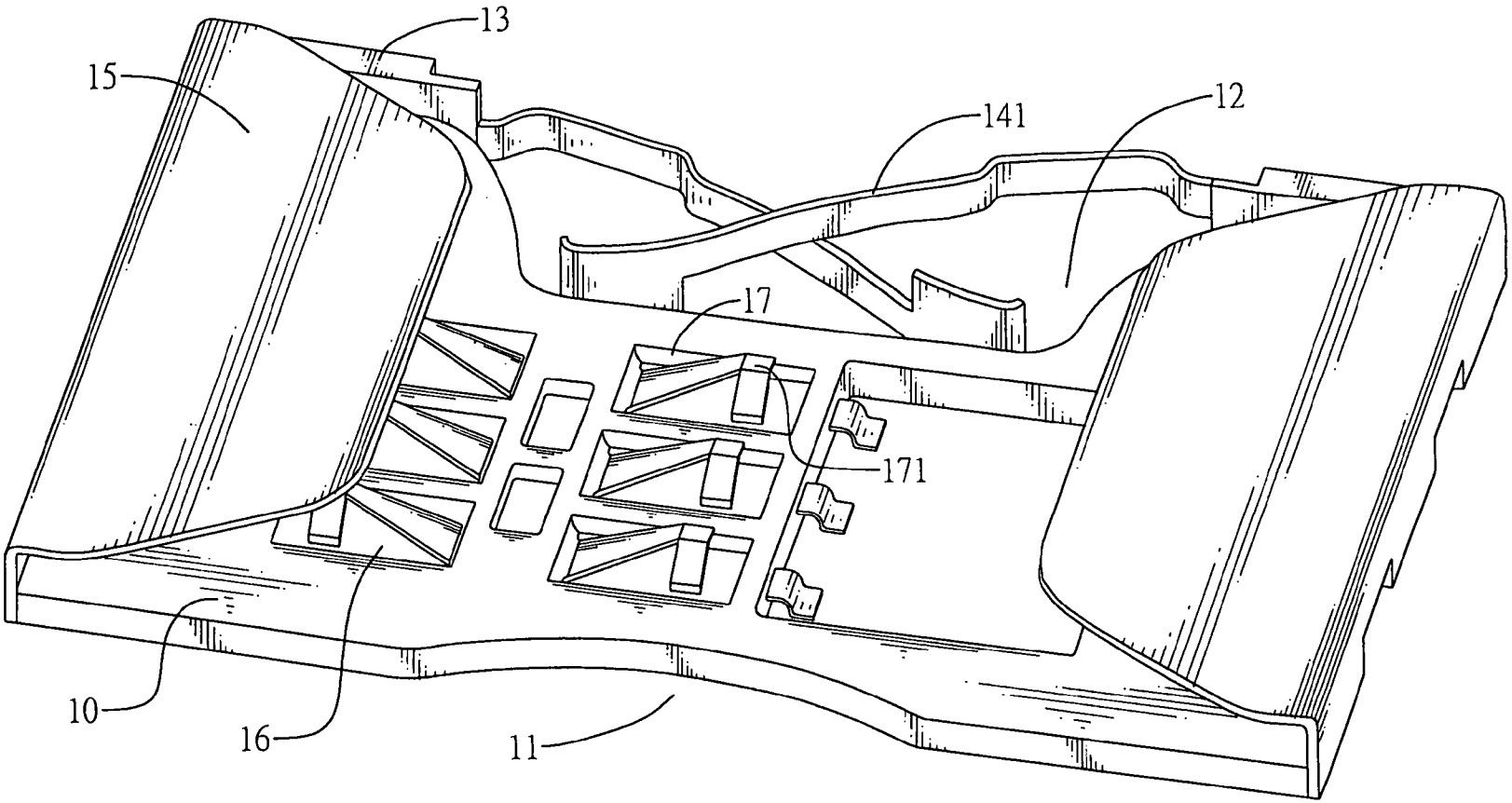
FIG. 1 is a perspective view of a first embodiment of a SIM card seat assembly in accordance with the present invention.
Figure 2:
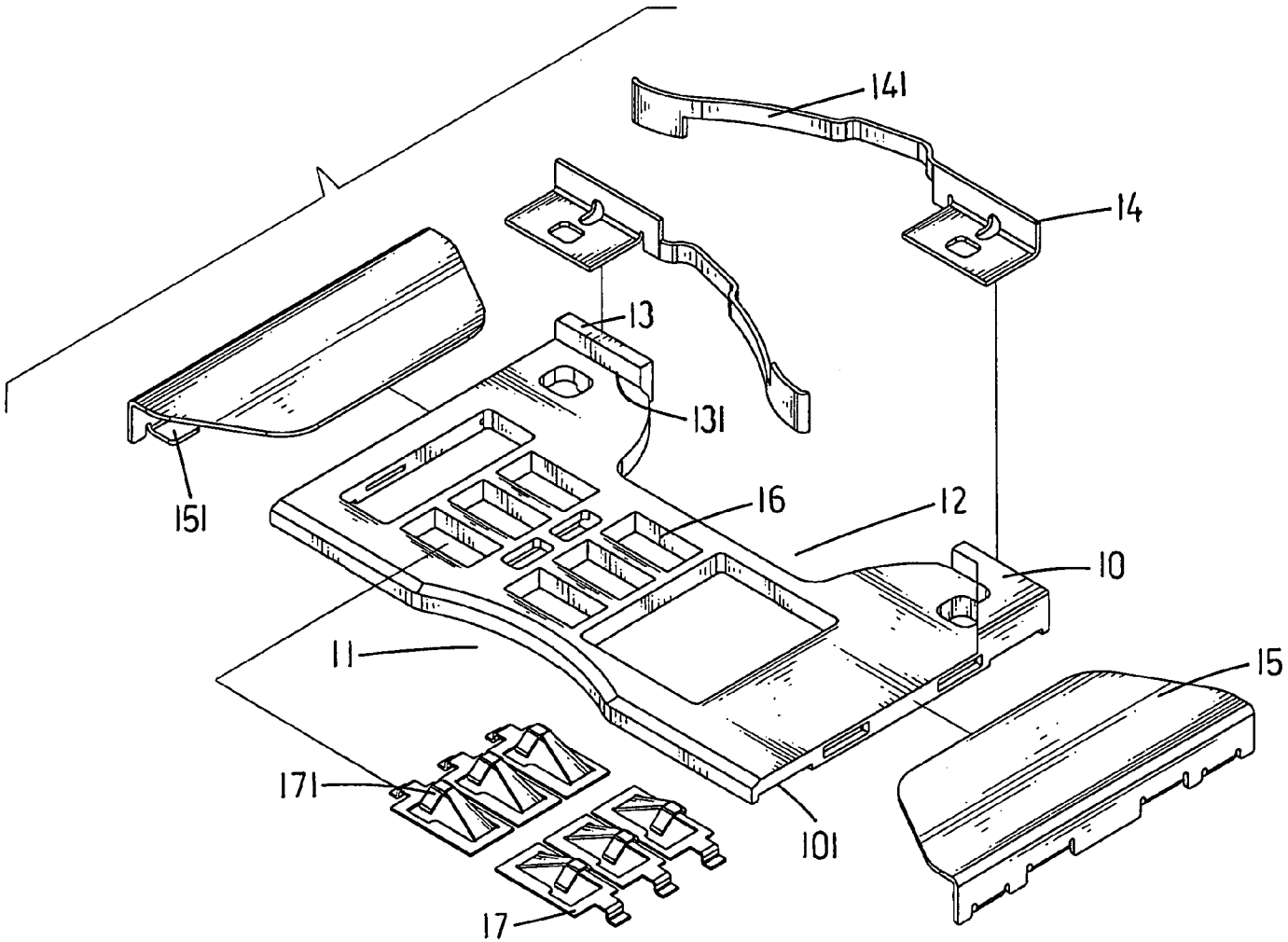
FIG. 2 is an exploded perspective view of the SIM card seat assembly in FIG. 1.

With reference to FIGS. 1 and 2, a SIM card seat assembly in accordance with the present invention comprises a base (10), terminals (17), two mounting tabs (15) and two ejection arms (14).

The base (10) has a top surface, a front edge, a rear edge, a right edge, a left edge, holes (16), mounting slots (101), two positive stops (13), a cutout (12) and a curved edge (11). The holes (16) are formed through the base (10). The mounting slots (101) are longitudinally formed respectively in the front edge and the rear edge of the base (10). The positive stops (13) are formed at the right edge of the base (10) and extend up from the top surface of the base (10). The positive stops (13) are opposite to each other and have bottoms and edges (131). Each edge (131) is formed on the bottom of the positive stop (13) and the top surface of the base (10). The cutout (12) is formed in the right edge of the base (10). The curved surface (11) is formed in the left edge of the base (10).

The terminals (17) are mounted in the holes (16) in the base (10) and have resilient contacts (171). The resilient contacts (17) protrude at an angle toward the top surface of the base (10) through the holes (16).

The mounting tabs (15) have tongues (151). The tongues (151) are mounted respectively in the mounting slots (101) in the base (10) to connect the mounting tabs (15) respectively to the front edge and the rear edge of the base (10).

Figure 3:
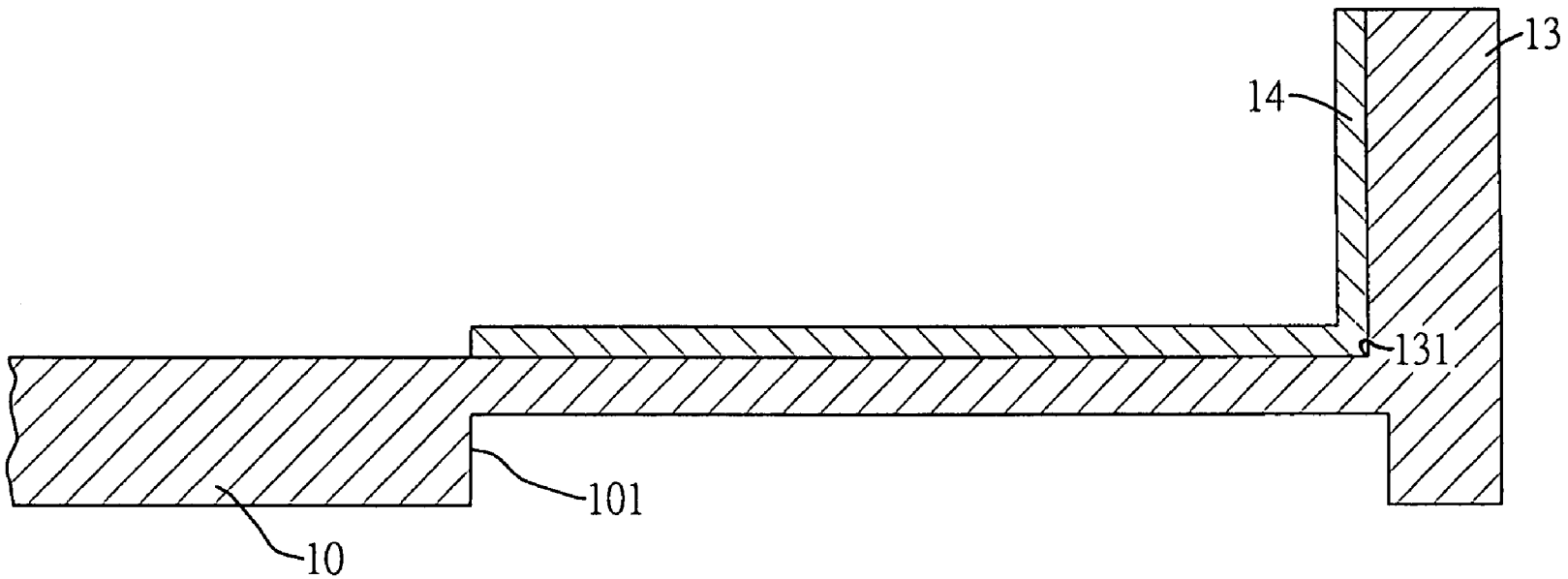
FIG. 3 is an enlarged cross sectional front view of the SIM card seat assembly in FIG. 1.

With Further reference to FIG. 3, the ejection arms (14) are complementary and are mounted on the edges (131) of the positive stops (13) and the top surface of the base (10). Each ejection arm (14) has a resilient arm (141). The resilient arms (141) extend into the cutout (12) toward and cross each other in the cutout (12) of the base (10) and press against a SIM card mounted on the base (10).

Figure 4:
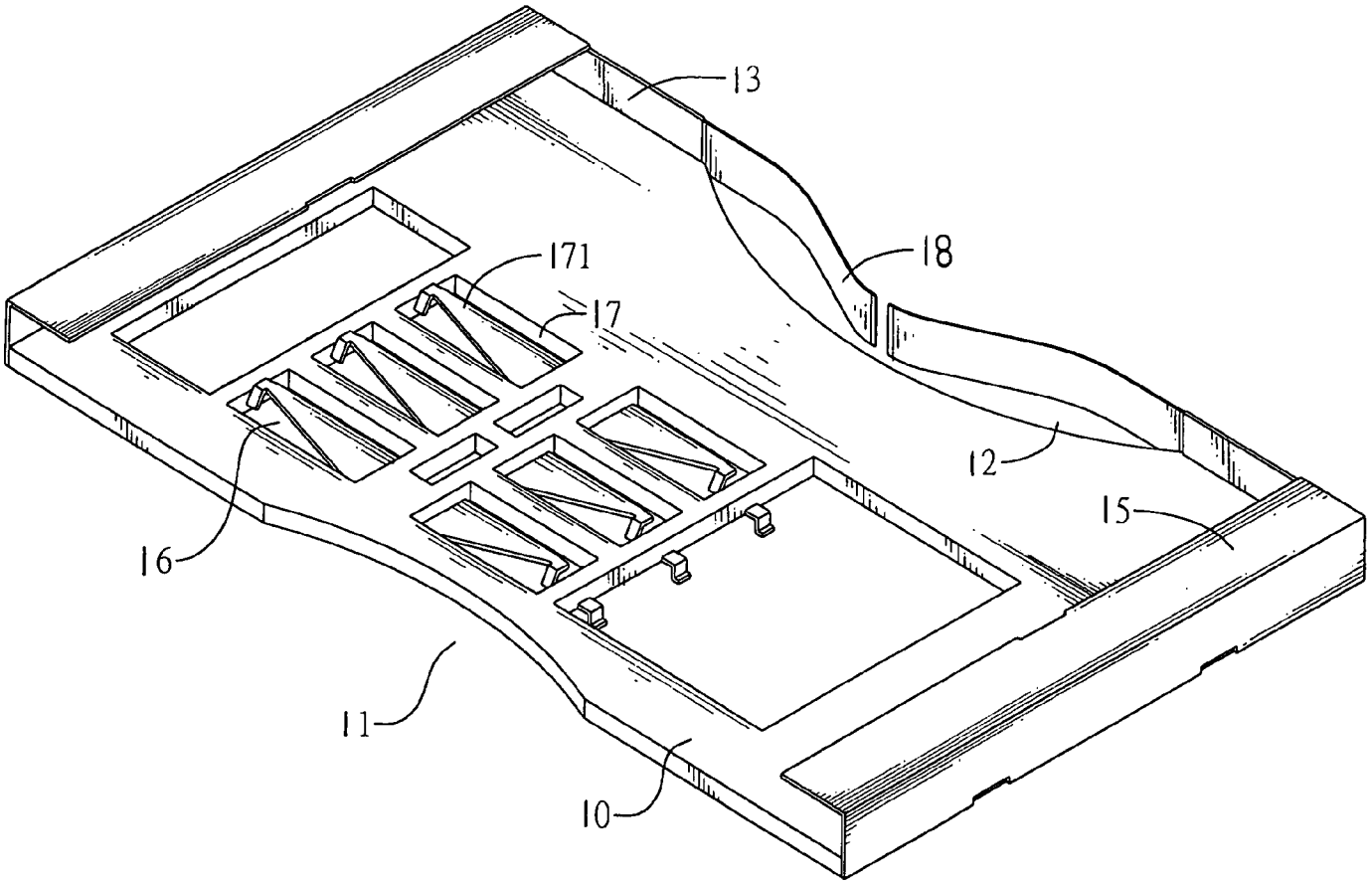
FIG. 4 is a perspective view of a second embodiment of the SIM card seat assembly in accordance with the present invention.
Figure 5:
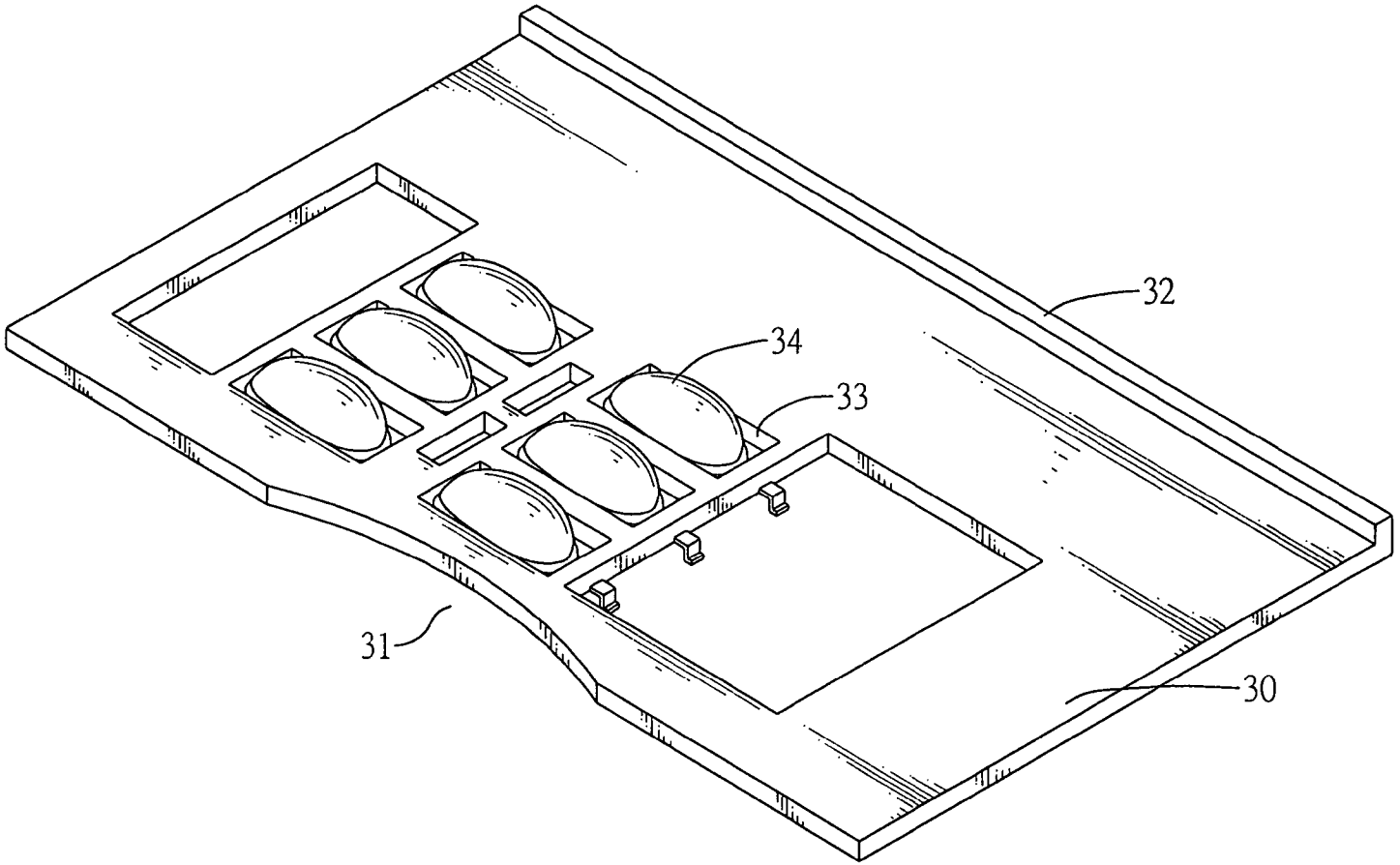
FIG. 5 PRIOR ART
FIG. 5 is a perspective view of a conventional SIM card seat assembly in accordance with the prior art.

With further reference to FIG. 4, a second embodiment of the SIM card seat assembly in accordance with the present invention has ejection arms (18) formed integrally with the positive stops (13). The ejection arms (18) are resilient, extend into the cutout (12) of the base (10) and curve toward the cutout (12).

When a SIM card is inserted into or removed from the SIM card seat assembly, the SIM card presses against the resilient contacts (171) and presses the resilient contacts (171) toward the base (10) so that chips on the SIM card are not scratched because the resilient contacts (171) are made by resilient matters. The resilient force press resilient contacts (171) toward to the base (10). When the SIM card is totally into or away the SIM card seat assembly, the resilient force lets the resilient contacts (171) back to a first position.

When the SIM card is totally inserted into the SIM card seat assembly, a locking device of a cell phone housing abutting to the cutout (12) of the base (10) locks the SIM card inside of the SIM card seat assembly. The SIM also presses against the ejection arms (14,18).

Furthermore, when the SIM card is removed from the SIM card seat assembly, the locking device on the cell phone housing is firstly removed and the ejection arms (14, 18) push the SIM card out of the SIM card seat assembly. Consequently, the SIM card is removed from the SIM card seat assembly without any difficulty.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A SIM card seat assembly comprising:

a base having a top surface;

a front edge;

a rear edge;

a right edge;

a left edge;

multiple holes formed through the base;

multiple mounting slots longitudinally formed respectively in the front edge and rear edge;

two positive stops formed at the right edge of the base, extending up from the top surface of the base, being opposite to each other and each having a bottoms; and an edge formed on the bottom and the top surface of the base;

a cutout formed in the right edge of the base; and a curved edge formed in the left edge of the base;

multiple terminals mounted in the holes in the base and each having a resilient contact protruding at an angle toward the top surface of the base through one of the holes;

two mounting tabs attached to the base and each having multiple tongues extending from the mounting tab and mounted respectively in the mounting slots in the base to connect the mounting tabs respectively to the front edge and the rear edge of the base; and two ejection arms being complementary and mounted on the edges of the positive stops and the top surface of the base, and each ejection arm having a resilient arm extending into the cutout of the base.

2. The SIM card seat assembly as claimed in claim 1, wherein the resilient arms cross each other in the cutout of the base.

* * * * *